US005172453A

United States Patent [19]

Akiyama

[11] Patent Number: 5,172,453

[45] Date of Patent: Dec. 22, 1992

[54] SLIVER CAN

[75] Inventor: Yasuo Akiyama, Kyoto, Japan

[73] Assignee: Murata Kikai Kabushiki Kaisha, Kyoto, Japan

[21] Appl. No.: 700,509

[22] Filed: May 15, 1991

[30] Foreign Application Priority Data

May 18, 1990 [JP] Japan ..... 2-52002[U]
May 18, 1990 [JP] Japan ..... 2-128315
May 21, 1990 [JP] Japan ..... 2-52178[U]

[51] Int. Cl.[5] ..... D04H 11/00
[52] U.S. Cl. ..... 19/159 R; 242/54.4
[58] Field of Search ..... 19/159 R, 159 A, 157; 206/389, 392; 242/54.4, 117, 129

[56] References Cited

U.S. PATENT DOCUMENTS

| | | | |
|---|---|---|---|
| 403,304 | 5/1889 | Sutcliffe | 19/159 R |
| 911,297 | 2/1909 | Dawson | 19/159 R |
| 2,478,960 | 8/1949 | Wilkie | 19/159 R |
| 2,780,838 | 2/1957 | Wilkie | 19/159 R |
| 2,959,279 | 11/1960 | Krafft et al. | 19/159 R |
| 3,135,038 | 6/1964 | Pflugrad | 19/159 R |
| 3,270,977 | 9/1966 | Tillou | 19/159 R |
| 3,295,170 | 1/1967 | Whitehurst | 19/159 R |
| 3,324,515 | 6/1967 | West | 19/159 R |
| 3,971,521 | 7/1976 | Crotti | 19/159 R |
| 4,142,280 | 3/1979 | Feffer | 19/159 R |

*Primary Examiner*—Werner H. Schroeder
*Assistant Examiner*—Michael A. Neas
*Attorney, Agent, or Firm*—Spensley Horn Jubas & Lubitz

[57] ABSTRACT

A sliver can which facilitates the location of a trailing end portion of the sliver. The sliver can includes a main body and a tubular member associated with the main body for receiving an end portion of the sliver. By positioning the end portion of the sliver in a specific area, i.e. the within tubular member, the end portion may be easily located.

1 Claim, 3 Drawing Sheets

SLIVER CAN

FIELD OF THE INVENTION

This invention relates to a method of storing a sliver in a can in such a way that its trailing end portion may be easily detected when the sliver is subsequently used and relates to a sliver can storing a sliver in such a way as to facilitate the location of its end portion.

RELATED ART STATEMENT

A sliver is stored in a double coiled form in a cylindrical sliver can having a closed bottom by a drawing frame prior to spinning, so that it may be easy to handle. The sliver can is conveyed to a spinning frame, and the sliver is drawn out of the can in its trailing end portion for feeding to the spinning frame. It is, therefore, desirable for the trailing end portion of the sliver to be easily detectable to be drawn out immediately when the sliver is used.

FIGS. 4 and 5 show a sliver stored in a can. As is shown therein, the sliver 4 as stored in the can 2 is in the form of a stack having a double coiled shape formed by moving the sliver circumferentially of the can and in such a way that it may form circles which are smaller in diameter than the can. It has been usual for the trailing end portion of the sliver 4 to simply rest on the top of the stack of the sliver 4 in the can 2.

This way of storing has, however, presented a problem connected with the detection of the trailing end portion of the sliver when it is subsequently used, since its end portion is difficult to locate on the stack.

OBJECT AND SUMMARY OF THE INVENTION

It is, therefore, an object of this invention to provide a method which can store a sliver in a can in such a way that its trailing end portion may be easy to locate when it is subsequently used.

It is another object of this invention to provide a sliver can which facilitates the subsequent location of the end of a sliver.

The object as hereinabove stated in attained by a method of storing a sliver in a can which comprises moving the sliver circumferentially of the can and in such a way that the sliver may form circles which are smaller in diameter than the can, until the circles form a stack consisting of an appropriate amount of sliver, and winding the trailing end portion of the sliver to form on the top of its stack a coil which is concentric to the can.

According to the method of storing as hereinabove defined, the trailing end portion of the sliver stored in the can forms a coil, or ring projecting above the top of its stack. Therefore, the end portion of the sliver is easy to locate subsequently, insofar as it is present only in a limited area defined by the projecting ring.

According to this invention, a sliver can may provide a member for receiving an end portion of the sliver or a member for storing information on the position of an end portion of the sliver.

DETAILED DESCRIPTION OF PREFERRED EMBODIMENTS

The invention will now be described in detail by way of example with reference to the accompanying drawings.

Figure 1:
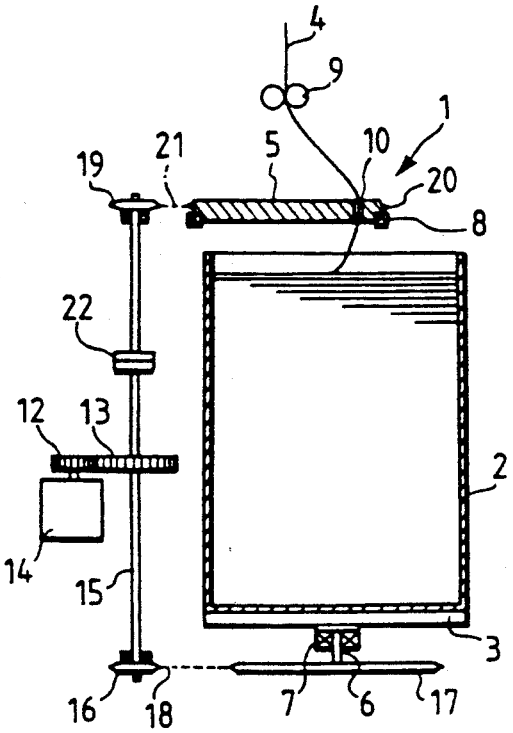
FIG. 1 is a side elevational view, partly in section, of the apparatus for carrying out this invention.
Figure 2:
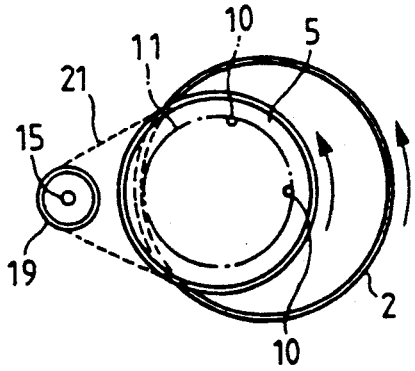
FIG. 2 is a schematic top plan view of the apparatus.

FIGS. 1 and 2 show an apparatus 1 for carrying out this invention, or a drawing frame. It has at its bottom a horizontal rotary table 3 on which a cylindrical can 2 having a closed bottom is mounted, while a horizontal rotary disk 5 is provided at its top for guiding a sliver 4 into the can 2. The rotary table 3 is provided at its bottom with a rotary shaft 6 which is coaxial with the table 3, and is rotatably supported by a bearing 7 on a framework not shown.

The rotary disk 5 is rotatably supported by a bearing 8 on a framework not shown, and has a center of rotation deviating from that of the rotary table 3. The rotary disk 5 is provided therethrough with a guide hole 10 through which the sliver 4 delivered down past feed rollers 9 is passed, and which is spaced apart from the center of rotation of the disk 5. The guide hole 10 is so positioned that upon rotation of the rotary disk 5, it may move along a circular path 11 which is smaller in diameter than the inner periphery of the can 2, and which is, as it were, inscribed in the can 2. If the rotary disk 5 is rotated, therefore, the sliver 4 which is fed down forms circles and is received in a coiled form in the can 2, and if the can 2 is simultaneously rotated by the rotary table 3, the coiled sliver 4 forms a coiled pattern circumferentially of the can 2. Thus, the sliver as a whole is stacked in a double coiled form.

An output shaft 15 is vertically supported along-side the rotary table 3, and is rotatable by a motor 14 through gears 12 and 13 for rotating the rotary table 3 and the rotary disk 5. The output shaft 15 has one end to which a driving sprocket 16 is attached, while a driven sprocket 17 is attached to the rotary shaft 6 for the rotary table 3, and a chain 18 is connected between the sprockets 16 and 17. Another driving sprocket 19 is attached to the other end of the output shaft 15, while another driven sprocket 20 is formed on the peripheral edge of the rotary disk 5, and a chain 21 is connected between the sprockets 19 and 20. The output shaft 15 is also provided with a clutch 22 for enabling and disabling the transmission of the output of the motor to the rotary disk 5.

Description will now be made of the manner in which the drawing frame 1 as hereinabove described is used for storing a sliver 4 in a can 2.

After an empty can 2 has been mounted on the rotary table 3 coaxially therewith, the motor 14 is started, while the clutch 22 is kept in its engaged position, and the sliver 4 is fed down through the feed rollers 9. The sliver 4 is received in the can 2, while forming circles as a result of its movement by the rotary disk 5, and as the can 2 is simultaneously rotated about its own axis, the sliver 4 is received in a double coiled form in the can 2.

Figure 3:
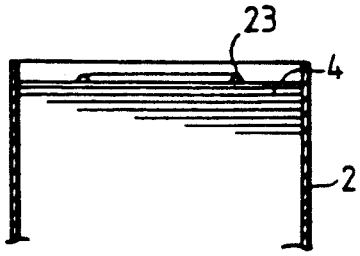
FIG. 3 is a sectional view showing the sliver stored in the can.
Figure 4:
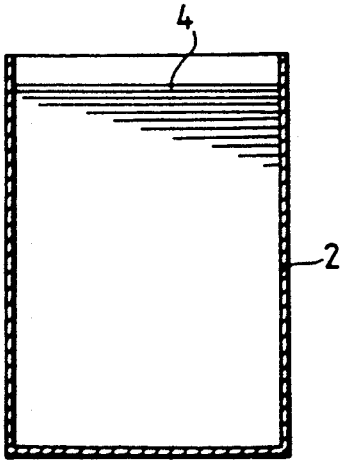
FIG. 4 PRIOR ART
FIG. 4 is a sectional view showing the sliver stored in a conventional way.

When a stack consisting of an appropriate amount of sliver 4 has been formed in the can 2, the clutch 22 is disengaged to stop the rotation of the rotary disk 5, while the can 2 is still kept in rotation, and after the can 2 has been rotated several more times, the sliver 4 is cut. As the can 2 is still rotated after the movement of the guide hole 10 has been stopped at, for example, its position as shown by a phantom line in FIG. 2, the trailing end portion of the sliver 4 is wound to form on the top of the stacked sliver 4 a raised ring portion 23 which is coaxial with the can 2, as shown in FIG. 3, and which contains the cut end (not shown) of the sliver 4, whereupon the work of putting the sliver 4 in the can is completed.

After the sliver 4 has been stacked appropriately in the can 2 by movement circumferentially of the can 2 while forming circles which are smaller in diameter than the can 2, the raised portion in the form of a ring containing the cut end of the sliver 4 is formed on the top of the stacked sliver 4 as the trailing end portion of the sliver 4 is wound on the top of its stack coaxially with the can 2, as hereinabove described. Therefore, it is only in a limited area defined by the raised portion 23 that the end of the sliver is present, and the end of the sliver 4 is easy to locate subsequently, only if the raised portion 23 is picked up.

Although the chains have been shown and described as means for driving the rotary table 3 and the rotary disk 5, they can be replaced by gears.

In summary, this invention makes it easy to locate the end of the sliver subsequently, insofar as it is present only in the limited area defined by the raised portion in the form of a ring formed on the top of the sliver stacked in the can.

Next, an embodiment of a sliver can which can keep a sliver in such a way as to facilitate the location of its end portion will be described hereinafter.

In view of the fact that a cylindrical open space remains in the center of a sliver can in which a sliver has been stored in a coiled form, a sliver can includes a tubular member provided for utilizing the open space to hold the end portion of the sliver.

The tubular member is provided in the center of a main body forming the can for holding the end portion of a sliver. Therefore, the end portion of any sliver stored in the can is always positioned in a specifically limited area, and the end of the sliver is easy to locate subsequently. The tubular member does not hinder the storage of any sliver, insofar as it is so situated as to occupy the open space which would be left in the sliver can by any sliver placed in a coiled form.

Figure 5:
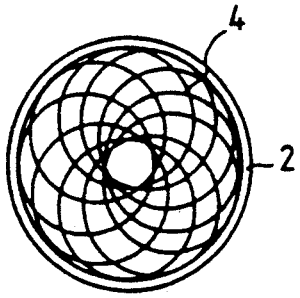
FIG. 5 PRIOR ART
FIG. 5 is a top plan view thereof.
Figure 6:
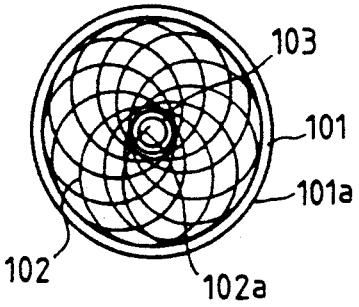
FIG. 6 is a top plan view of a sliver can embodying this invention.
Figure 7:
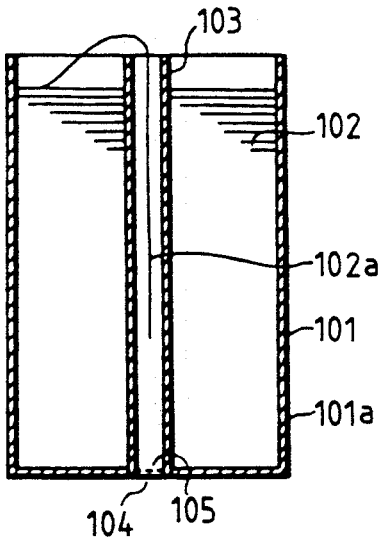
FIG. 7 is a longitudinal sectional view of the sliver can.

FIGS. 6 and 7 show a sliver can 101 comprising a cylindrical main body 101*a* having a closed bottom in which a sliver 102 can be stored in a coiled form by a drawing frame. The sliver 102 is stored as a result of its gradual movement along the inner periphery of the can 101, while forming circles having a diameter which is larger than the radius of the can 101. The storage of the sliver 102, therefore, leaves a cylindrical open space (as shown at S in FIG. 5) in the center of the sliver can 101 (or along its axis).

The open space S is utilized for the provision of a tubular member 103 in the center of the main body 101*a* of the can for receiving an end portion 102*a* of the sliver 102. The tubular member 103 is secured to the bottom of the main body 101*a*, is upstanding therefrom, and is substantially of the same height with the main body 101*a*. The tubular member 103 is preferably circular in cross section, but may alternatively be, for example, square.

The main body 101*a* has at its bottom a hole 104 defining an open bottom for the tubular member 103, and covered with a net 105.

After any sliver 102 has been put in the sliver can 101, its end portion 102*a* is put in the tubular member 103 in the center of the main body 101*a*. The tubular member 103 provides a specifically limited area for holding the end portion 102*a* of any sliver 102 put in the can 101, and thereby facilitates the subsequent location of the end 102*a* of the sliver 102. Moreover, the tubular member 103 does not form any obstacle at all to the storage of the sliver 102, insofar as it is so positioned as to occupy only the open space S which would necessarily be left in the can 101 by the sliver 102 stored in a coiled form.

The end portion 102*a* of the sliver 102 is very easy to put in the tubular member 103, if air is drawn out through the hole 104 at the bottom of the main 101*a* of the can. There is no possibility of the sliver 102 being drawn out through the hole 104, as the hole 104 is covered with the net 105. The subsequent removal of the end portion 102*a* of the sliver 102 from the tubular member 103 can be accomplished automatically if compressed air is blown into the tubular member 103 through the hole 104.

In summary, this invention facilitates the subsequent location of the end of any sliver, since the tubular member provided in the center of the main body of the can defines a specifically limited site for the end portion of the sliver.

Another embodiment of a sliver can will be illustrated.

A sliver can of this embodiment includes a magnetic memory provided in its main body for keeping a sliver for storing information on the position of its end portion.

As information on the position of the end portion of the sliver in the can is stored in the magnetic memory provided in its main body, it is easy to locate the end portion of the sliver subsequently if the information is extracted from the memory.

Figure 8:
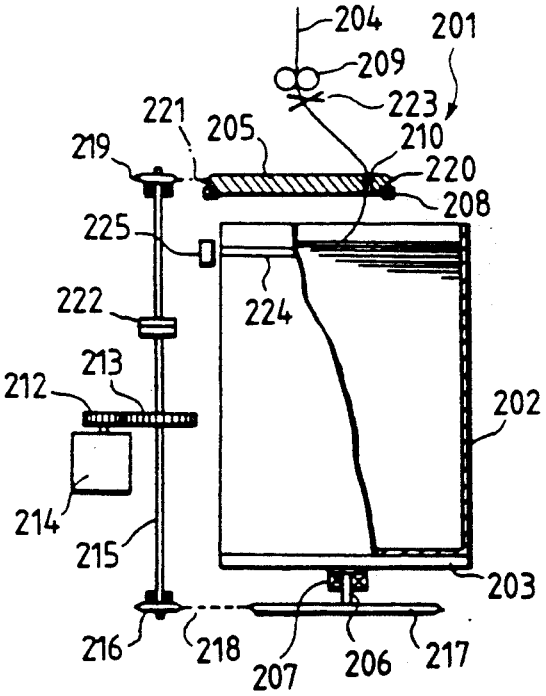
FIG. 8 is a side elevational view, partly in section, of another sliver can embodying this invention.
Figure 9:
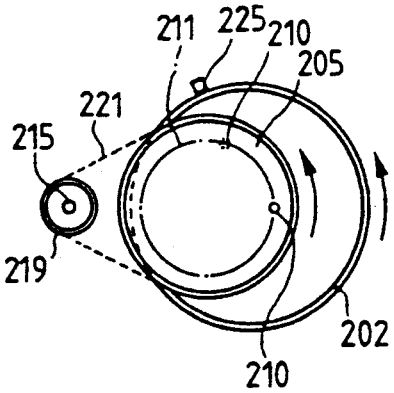
FIG. 9 is a schematic top plan view thereof.

Referring first to FIGS. 8 and 9, there is shown a drawing frame 201 used for putting a sliver 204 in the main body 202 of a can which is cylindrical and closed at its bottom. The drawing frame 201 includes a horizontal rotary table 203 on which the main body 202 of the can is mounted, and a horizontal rotary disk 205 disposed above the rotary table 203 for guiding the sliver 204 into the main body 202. The rotary table 203 is provided at its bottom with a rotary shaft 206 which is coaxial with the table 203, and is rotatably supported by a bearing 207 on a framework not shown.

The rotary disk 205 is rotatably supported by a bearing 208 on a framework not shown in an eccentric relation to the rotary table 203. The rotary disk 205 is provided therethrough with a guide hole 210 which is spaced apart from the center of rotation of the disk 205, and through which the sliver 204 fed down past feed rollers 209 is passed. The guide hole 210 is so positioned that upon rotation of the rotary disk 205, it may move along a circular path 211 which is smaller in diameter than the inner periphery of the main body 202 of the can, and which is, as it were, inscribed in the main body 202. If the rotary disk 205 is rotated, therefore, the sliver 204 which is fed down forms circles and is received in a coiled form in the main body 202, and if the main body 202 is simultaneously rotated by the rotary table 203, the coiled sliver 204 forms a coiled pattern circumferentially of the main body 202. Thus, the sliver as a whole is stacked in a double coiled form.

Figure 10:
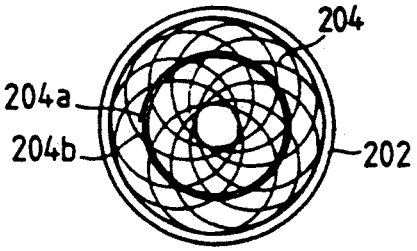
FIG. 10 is a top plan view showing a sliver kept in the main body the can.

An output shaft 215 is vertically supported along-side the rotary table 203, and is rotatable by a motor 214 through gears 212 and 213 for rotating the rotary table 203 and the rotary disk 205. The output shaft 215 has one end to which a driving sprocket 216 is attached, while a driven sprocket 217 is attached to the rotary shaft 206 for the rotary table 203, and a chain 218 is connected between the sprockets 216 and 217. Another driving sprocket 219 is attached to the other end of the output shaft 215, while another driven sprocket 220 is formed on the peripheral edge of the rotary disk 205, and a chain 221 is connected between the sprockets 219 and 220. The output shaft 215 is also provided with a clutch 222 for enabling and disabling the transmission of the output of the motor to the rotary disk 205. When an appropriate amount of sliver 204 has been received in the main body 202 of the can, the clutch 222 is disengaged to stop the rotation of the rotary disk 205, and after the main body 202 of the can alone has been rotated several more times, the sliver 204 is cut by a cutter 223, whereupon the end portion of the sliver 204 having a cut end 204*a* is wound to form a ring on the top of the stacked sliver, as shown in FIG. 10. It, therefore, follows that the end 204*a* of any sliver 204 stored in the can can be found in its portion 204*b* wound in a ring form. A magnetic memory 224, e.g. a magnetic tape, is bonded to the outer peripheral surface of the main body 202 continuously about its circumference for storing information on the position of the sliver end 204*a*, so that the end 204*a* may be still easier to locate. The drawing frame 1 includes an inputting device 225 for inputting information on the position of the sliver end 204*a* to the magnetic memory 224. The rotary disk 205 is adapted for stopping its rotation when its guide hole 210 has arrived at a definite position, and the inputting device 225 is so positioned as to be aligned with the guide hole 210 staying at its definite position. The inputting device 225 inputs information to the magnetic memory 224 immediately upon passage of a certain length of time after the functioning of the cutter 223 (i.e. as soon as the cut end of the sliver has fallen in the can). Therefore, the position as inputted coincides with the position of the sliver end 204*a* as viewed circumferentially of the main body 202 of the can.

Referring to the manner of placing a sliver 204 in an empty can, its main body 202 is mounted on the rotary table 203 coaxially therewith, and the motor 214 is started, while the clutch 222 is kept in its engaged position, and the sliver 204 is fed down past the feed rollers 209. The sliver 204 is received in the main body 202, while the rotary disk 205 forms it into circles or loops, and as the main body 202 is also rotated, those loops are formed along the circumference of the main body 202, so that the sliver is stacked in a double coiled form.

When an appropriate amount of sliver 204 has been stacked in the main body 202 of the can, the clutch 222 is disengaged to stop the rotation of the rotary disk 205, while the main body 202 is still kept in rotation, and the sliver 204 is cut by the cutter 223, whereupon the end portion of the sliver 204 is wound on the top of the stacked sliver 204 coaxially with the main body 202. As soon as the cut end 204*a* of the sliver 204 falls on the top of the stacked sliver 204, its position is inputted to the magnetic memory 224 on the main body 202 by the inputting device 225. Therefore, it is easy to ascertain the position of the sliver end 204*a* and locate it subsequently, if its position as inputted in the magnetic memory 224 is found by a readout device. The sliver can can be used repeatedly if the information stored in the magnetic member 224 is erased.

Figure 11:
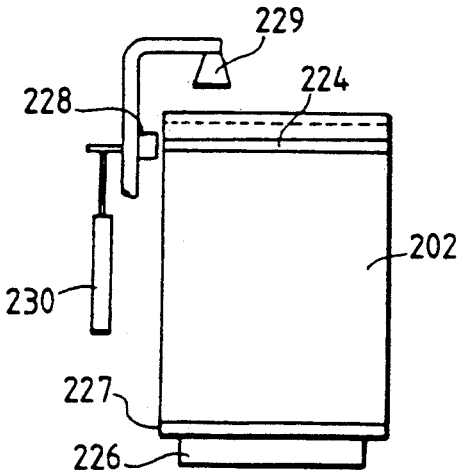
FIG. 11 is a side elevational view of a sliver searching system.

FIG. 11 shows a sliver searching system. It includes a rotary table 227 provided with a rotating device 226, on which the main body 202 of a can holding a sliver 204 therein is mounted, and a readout device 228 situated alongside the main body 202 for reading out the information as stored in the magnetic memory 224. A suction mouth 229 is provided in combination with the readout device 228 and is so positioned as to face the end 204*a* of the sliver in the main body 202 of the can, and a cylinder 230 is connected for raising and lowering the suction mouth 229. The main body 202 is rotated to allow the readout device 228 to search the information as stored in the magnetic memory 224, whereby the end 204*a* of the sliver 204 is located. Then, the rotary table 227 is stopped, and the suction mouth 229 is lowered to suck the end 204*a* of the sliver 204 in the main body 202, so that the end 204*a* of the sliver 204 can be drawn out of the main body 202 automatically.

Figure 12:
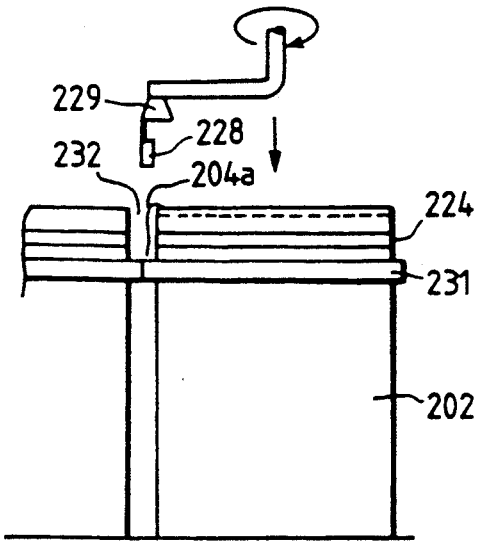
FIGS. 12 and 13 are side elevational views of still another sliver can embodying this invention.

FIG. 12 shows a sliver can having a flange 231 formed on the outer peripheral surface of its main body 202, and provided with a magnetic memory 224 on the main body 202 above (or below) the flange 231. The end portion 204*a* of the sliver 204 received in the main body 202 is hung over its top edge, and its position as hung is inputted to the magnetic memory 224. The flanges 231 of two adjoining sliver cans, respectively, define an open space 232 therebetween, so that there is no possibility of the hung end portion 204*a* of any sliver being caught between the two cans. The end portion 204*a* of the sliver is easy to locate and draw if a readout device 228 and a suction mouth 229 situated above it are lowered alongside the main body 202 of the can, and rotated about it.

Figure 13:
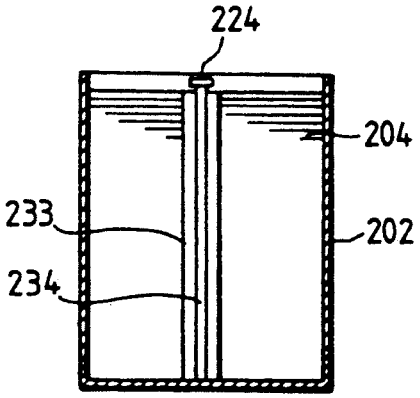

FIG. 13 shows a sliver can having an upright post 234 so positioned as to stay in a cylindrical open space 233 which is necessarily defined along the axis of its main body 202 by a sliver 204 received in a double coiled form, and including a magnetic memory 224, e.g. a magnetic disk, attached to the upper end of the post 234. The magnetic memory 224 is situated within the main body 202, and therefore, is not easily damaged, but has an improved durability.

The magnetic memory provided on the main body of the can according to the embodiment of this invention for storing information on the position of the end of a sliver in the can makes it easy to locate the end of the sliver subsequently, as it is sufficient to read out the information as stored in the magnetic memory.

What is claimed is:

1. In a sliver storing apparatus including a horizontal rotary table for supporting a cylindrical can having a closed bottom, the horizontal rotary table defining a center of rotation, and a horizontal rotary disk rotatably supported at the top of the rotary table for guiding a sliver into the can, the rotary disc defining a center of rotation deviating from the center of rotation of the horizontal rotary table, a sliver can comprising:

a main body, and a tubular member associated with the main body for receiving an end portion of the sliver, the tubular member arranged substantially coaxially with the main body, wherein a bottom of the main body defines a hole associated with the tubular member, the hole covered with a net.

* * * * *